US006211620B1

(12) United States Patent
Gyoten et al.

(10) Patent No.: US 6,211,620 B1
(45) Date of Patent: Apr. 3, 2001

(54) BALLAST FOR FLUORESCENT LAMP

(75) Inventors: Masayoshi Gyoten, Shiga; Masataka Ozawa, Hyogo; Masanobu Murakami; Koji Miyazaki, both of Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/393,896

(22) Filed: Sep. 10, 1999

(30) Foreign Application Priority Data

Sep. 24, 1998 (JP) ..... 10-269481

(51) Int. Cl.[7] ..... H05B 39/04

(52) U.S. Cl. ..... 315/106; 315/94; 315/107; 315/291; 315/307; 315/209 R

(58) Field of Search ..... 315/106, 107, 315/105, 94, 101, 102, 247, 224, 291, 307, 219, 209 R

(56) References Cited

U.S. PATENT DOCUMENTS 5,502,423 * 3/1996 Okude et al. ..... 315/291
5,677,601 * 10/1997 Zuchtriegel ..... 315/209 R
5,880,562 * 3/1999 Nakagawa et al. ..... 315/224
5,994,843 * 11/1999 Kataoka et al. ..... 315/106
6,018,221 * 1/2000 Ohtake ..... 315/307
6,054,815 * 4/2000 Sugita et al. ..... 315/244

FOREIGN PATENT DOCUMENTS 7-272873 10/1995 (JP) .

* cited by examiner

*Primary Examiner*—Don Wong
*Assistant Examiner*—Tuyet T. Vo
(74) *Attorney, Agent, or Firm*—Merchant & Gould P.C.

(57) ABSTRACT

A ballast for a fluorescent lamp includes a high frequency power source circuit for supplying a preheat start type fluorescent lamp with preheating and lighting current via an inductor. The high frequency power source circuit includes at least two switching elements for controlling application of voltages of different polarity to the fluorescent lamp, a self-exciting type switching element driving circuit for driving the switching elements so as to alternate on and off repeatedly; and a timer circuit for detecting lapse of a predetermined time from start of the ballast for the fluorescent lamp. The switching element driving circuit shortens an ON-period of at least one of the switching elements to restrict an increase of an amplitude of current flowing in the inductor during a period until the timer circuit detects lapse of a predetermined time.

5 Claims, 8 Drawing Sheets

BALLAST FOR FLUORESCENT LAMP

BACKGROUND OF THE INVENTION

1. Field of the Invention

The present invention relates to a ballast for a fluorescent lamp using an inverter power source.

2. Description of the Prior Art

Conventionally, a ballast for a fluorescent lamp using a series inverter as shown in FIG. 8 is known. In the series inverter as shown in FIG. 8, when a switch 79 is turned on, an AC voltage supplied from an AC power source 78 is rectified by a rectifying circuit 80. The output current charges a smoothing capacitor 81 and also charges a capacitor 87 via a resistor 86. When the voltage of the capacitor 87 reaches the breakdown voltage of a trigger element 88, the charges of the capacitor 87 are supplied to the gate of a FET 84 so that the FET 84 turns on.

When the FET 84 turns on, the charges of the capacitor 87 are discharged via a resistor 90, a diode 89 and the FET 84 instantly. Thus, the voltage of the capacitor 87 drops and the trigger element 88 turns off. Further, the current from the AC power source 78 flows through a loop including the rectifying circuit 80, a capacitor 82, an electrode 73A of a fluorescent lamp 72, a parallel circuit composed of a capacitor 74 and a positive characteristic thermistor 70, an electrode 73B of the fluorescent lamp 72, a choke coil 75, a primary winding 85B of a current transformer 85 and the FET 84. This current increases gradually. As a result, the current through the primary winding 85B of the current transformer 85 generates a voltage in a secondary winding 85C of the current transformer 85, and this voltage supplies a gate voltage to the FET 84. Thus, the FET 84 is maintained to be on.

When the current flowing through the windings of the current transformer 85 increases enough, the core of the current transformer 85 is saturated magnetically. The magnetic saturation in the core of the current transformer 85 stops the output of the secondary winding 85C so that the FET 84 cannot be supplied with a gate voltage and thus turns off.

At this point, the energy accumulated in the choke coil 75 causes current to continue to flow through a loop including a parasitic diode 83A of the FET 83, a capacitor 82, the electrode 73A of the fluorescent lamp 72, a parallel circuit composed of the capacitor 74 and the positive characteristic thermistor 70, the electrode 73B of the fluorescent lamp 72, the choke coil 75 and the primary winding 85B of the current transformer 85. This current decreases gradually.

This current becomes primarily a resonance current of the choke coil 75 and the capacitor 74. When this current reverses, the output polarity of the secondary winding 85A reverses so that the FET 83 turns on. When the core of the current transformer 85 is saturated magnetically again, the output from the secondary winding 85A stops, and the FET 83 cannot be supplied with a gate voltage and thus turns off. At the same time, the gate voltage supplied from the secondary winding 85C turns the FET 84 on again. Thereafter, the above-described operations are repeated.

The resonance current of the choke coil 75 and the capacitor 74 flows through the electrodes 73A and 73B of the fluorescent lamp 72 and heats these electrodes. Immediately after the switch 78 is turned on, the temperature of the positive characteristic thermistor 70 is low and the resistance value thereof is small. Therefore, the charging current that flows into the capacitor 74 connected in parallel to the positive characteristic thermistor 70 is small, and the voltage across the capacitor 74 is small. Therefore, a resonant voltage sufficient to activate the fluorescent lamp 72 is not applied across the fluorescent lamp 72.

The temperature of the electrodes of the fluorescent lamp 72 is raised to a temperature sufficient to generate thermoelectrons as time passes. Furthermore, the positive characteristic thermistor 70 rises in temperature due to Joule heat, and the resistance value thereof rises. As a result, the voltage across the capacitor 74 reaches a resonant voltage sufficient to activate the fluorescent lamp 72. Thus, the fluorescent lamp 72 is activated and stays lit up. In the manner as described above, the electrodes 73A and 73B of the fluorescent lamp 72 start discharging after they are preheated and reach a state where thermoelectrons are supplied sufficiently. Therefore, the loss of active substances applied to the electrodes 73A and 73B due to positive ion bombardment can be reduced, so that the life of the fluorescent lamp 72 can be prolonged.

However, in the conventional ballast for a fluorescent lamp as described above, when the resistance value of the positive characteristic thermistor 70 is excessively small at room temperature, the period from the introduction of the power to the lighting of the fluorescent lamp becomes long, namely, it takes a long time to preheat the electrodes. Thus, the instant startability of the ballast is poor.

On the other hand, when the resistance value of the positive characteristic thermistor is excessively large, the initial resonance current is large, and an increase in the resistance value due to an increase in the temperature of the positive characteristic thermistor becomes steep. Therefore, the fluorescent lamp may be activated in a premature state where the electrodes have not generated thermoelectrons sufficiently yet. In this case, the active substances in the electrodes are lost readily due to positive ion bombardment, and the life of the fluorescent lamp becomes short. Since it is necessary to reduce the increase rate of the temperature of the positive characteristic thermistor in order to solve this problem, a positive characteristic thermistor having a large heat capacity, namely, a large-scale and expensive positive characteristic thermistor is required.

Furthermore, in the case where the fluorescent lamp is restarted after it is turned off and before the positive characteristic thermistor is cooled to room temperature, the following problem may arise. When the resistance value of the positive characteristic thermistor is large, the fluorescent lamp is activated in a premature state where the electrodes have not generated thermoelectrons sufficiently yet. Thus, the life of the fluorescent lamp becomes short.

SUMMARY OF THE INVENTION

Therefore, with the foregoing in mind, it is an object of the present invention to provide a ballast for a fluorescent lamp having a compact and inexpensive circuit configuration that can start with preheating and light up a fluorescent lamp instantly and hardly deteriorates electrodes of the fluorescent lamp at the start and at the restart in a short time after the fluorescent lamp is put out.

In order to achieve the object, the present invention provides an improved ballast for a fluorescent lamp including a high frequency power source circuit for supplying a preheat start type fluorescent lamp with preheating and lighting current via an inductor. The high frequency power source circuit includes at least two switching elements for respectively controlling application of voltages of different polarity to the fluorescent lamp; a self-exciting type switching element driving circuit for driving the switching elements so as to alternate on and off repeatedly; and a timer circuit for detecting the lapse of a predetermined time from the start of the ballast for the fluorescent lamp. The switching element driving circuit shortens an ON-period of at least one of the switching elements to restrict an increase of an amplitude of current flowing in the inductor during a period until the timer circuit detects the lapse of a predetermined time.

This embodiment ensures that the fluorescent lamp is preheated during a predetermined period in which duty control restricts an increase of the amplitude of current flowing in the inductor. Furthermore, after the predetermined period has passed, the amplitude of the current flowing in the inductor increases, so that the fluorescent lamp lights up. Thus, a compact and inexpensive ballast for a fluorescent lamp can be achieved without using a positive characteristic thermistor, which conventionally has been required.

Preferably, the switching element driving circuit in the above embodiment includes a switch control element for turning off the predetermined switching element in response to current flowing in the inductor to shorten the ON period. The switch control element is controlled to operate only during a period until said timer circuit detects lapse of a predetermined time.

Further, it is preferable that the inductor is provided with a secondary winding, an output voltage signal of the secondary winding being supplied to said switch control element. The switch control element operates in response to the output voltage signal of the secondary winding so as to turn off the predetermined switching element when the output voltage signal of the secondary winding exceeds a predetermined voltage.

Also, it is preferable that the switch control element maintains an operation state where it turns off the predetermined switching element, by a kick voltage generated in the secondary winding of said inductor when the switching element is switched between on and off. This embodiment eliminates a complicated configuration for maintaining the switching elements off. Therefore, a ballast for a fluorescent lamp having a further simplified circuit configuration can be achieved.

Preferably, the timer circuit in the above embodiment includes a capacitor being charged so as to reach a predetermined voltage after said predetermined time passes from start of the ballast, whereby the lapse of said predetermined time is detected based on a voltage of said capacitor; and a resistor for discharging charges of said capacitor after the fluorescent lamp is put out. According to this embodiment, residual charges in the capacitor can be discharged instantly after the fluorescent lamp is put out. Therefore, even if the fluorescent lamp is restarted in a short time after the lamp is put out, the fluorescent lamp can be lit up after sufficient preheating is performed. Thus, the deterioration of the electrodes of the fluorescent lamp can be prevented so that the life of the fluorescent lamp can be prolonged.

These and other advantages of the present invention will become apparent to those skilled in the art upon reading and understanding the following detailed description with reference to the accompanying figures.

DESCRIPTION OF THE PREFERRED EMBODIMENTS

Hereinafter, one embodiment of the present invention will be described with reference to the accompanying drawings.

Figure 1:
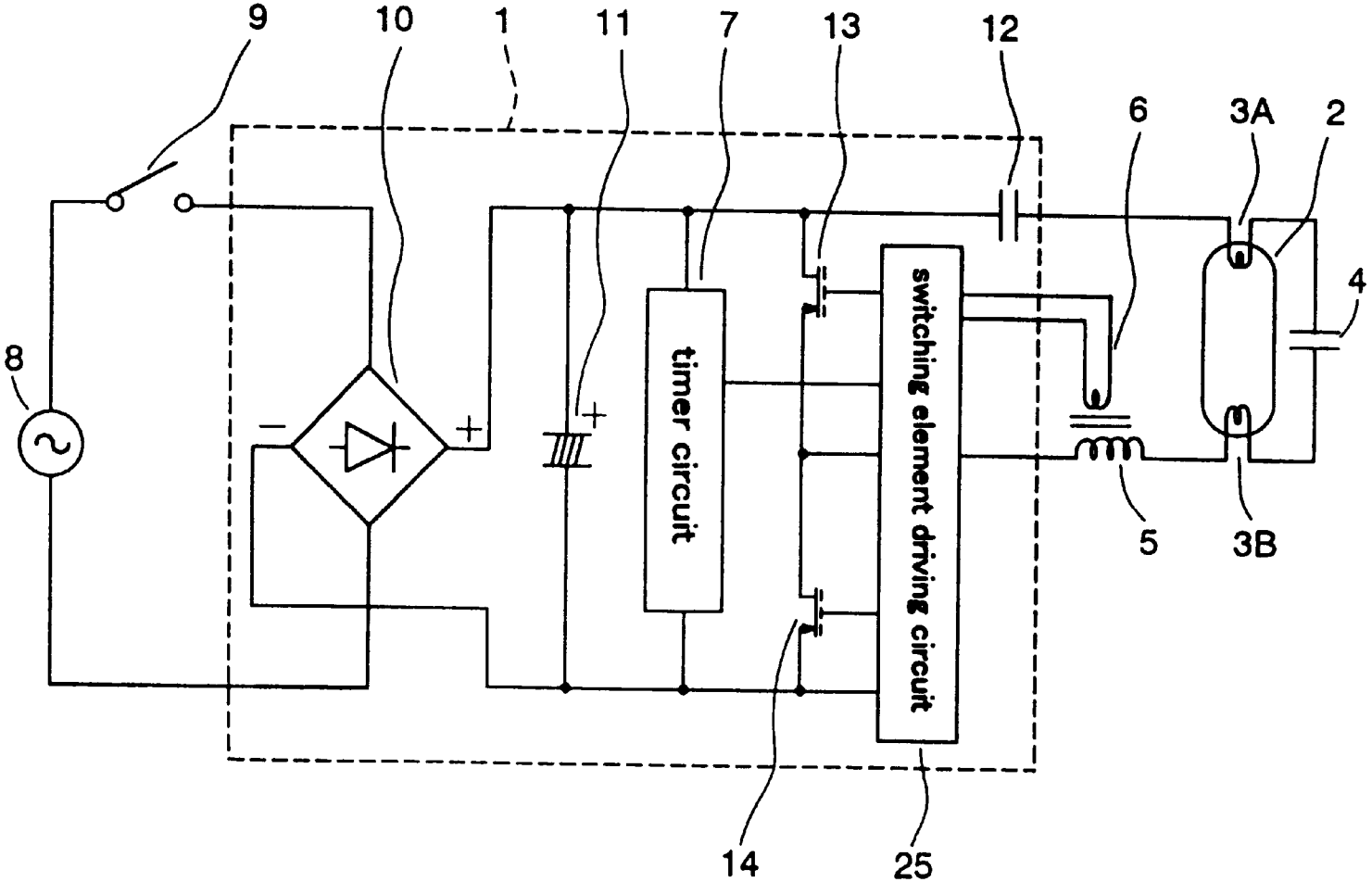
FIG. 1 is a circuit diagram showing the general outline of a ballast for a fluorescent lamp of one embodiment of the present invention.

FIG. 1 shows a schematic configuration of a ballast for a fluorescent lamp of this embodiment. The ballast for a fluorescent lamp of this embodiment includes a high frequency power source circuit 1 connected to an external AC power source 8 via a switch 9 and a preheat start type fluorescent lamp 2 that is preheated and lit up by the high frequency power source circuit 1 via a choke coil 5 (inductor) and a capacitor 4.

The high frequency power source circuit 1 includes at least two switching elements 13 and 14, a switching element driving circuit 25 for driving the switching elements 13 and 14 so as to alternate on and off repeatedly, and a timer circuit 7. Further, the circuit 1 includes a rectifying circuit 10 and a smoothing capacitor 11. At a portion connecting with the fluorescent lamp 2, a capacitor 12 is inserted.

The switching element driving circuit 25 shortens the ON-period of at least one of the switching elements 13 and 14 during a predetermined period set by the timer circuit 7 at the start of the fluorescent lamp 2. This operation of shortening the ON-period is performed in response to an output voltage signal of a secondary winding 6 of the choke coil 5.

Figure 2:
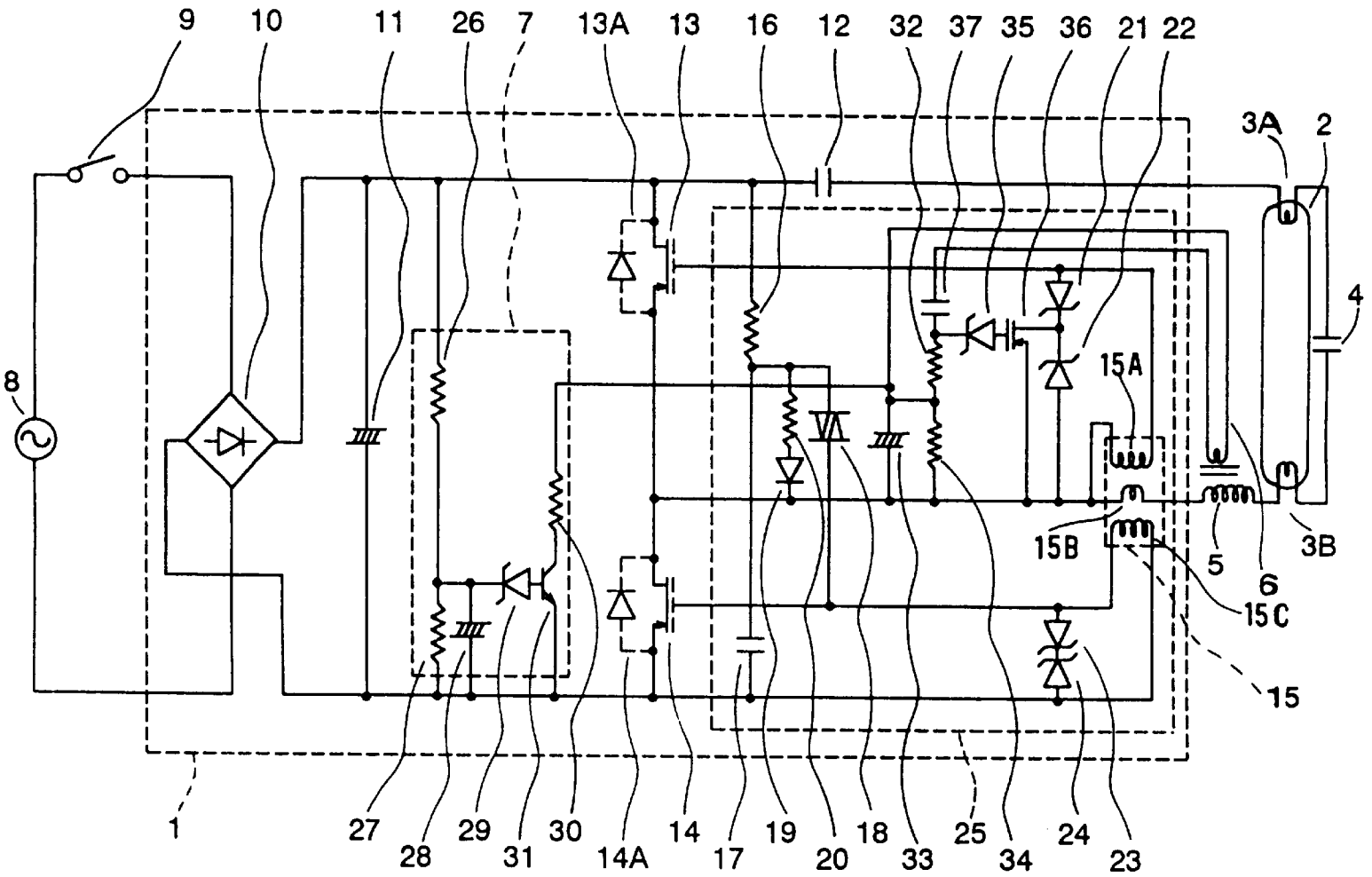
FIG. 2 is a circuit diagram showing a detailed configuration of the ballast for a fluorescent lamp of FIG. 1.

FIG. 2 shows a detailed configuration of the ballast for a fluorescent lamp of this embodiment. The AC power source 8 is connected to the AC input terminal of a rectifying circuit 10 via an external switch 9, and a smoothing capacitor 11 is connected to the DC output terminal of the rectifying circuit 10. The timer circuit 7 and a series circuit composed of a resistor 16 and a capacitor 17 are connected in parallel to the smoothing capacitor 11. In the timer circuit 7, a parallel circuit composed of a resistor 27 and a capacitor 28 is connected in series with a resistor 26, and the base of a transistor 31 is connected to the junction between the resistors 26 and 27 via a Zener diode 29.

The smoothing capacitor 11 is an electrolytic capacitor, and the drain of a first FET 13 is connected to the anode of the smoothing capacitor 11. The drain of a second FET 14 is connected to the source of the first FET 13, and the cathode of the smoothing capacitor 11 is connected to the source of the second FET 14.

In the switching driving circuit 25, the junction between the resistor 16 and the capacitor 17 is connected to the gate of the second FET 14 via a trigger diode 18. The junction between the resistor 16 and the capacitor 17 also is connected to the drain of the second FET 14 (the source of the first FET 13) via a series circuit composed of a diode 19 and a resistor 20.

The anode of the smoothing capacitor 11 is connected, as a first output terminal of the high frequency power source circuit 1, to one terminal of a first electrode 3A of the fluorescent lamp 2 via a capacitor 12. The junction between the first FET 13 and the second FET 14 is connected, as a second output terminal of the high frequency power source circuit 1, to one terminal of the choke coil 5, which is an inductor, via a primary winding 15B of a current transformer 15. The other terminal of the choke coil 5 is connected to one terminal of a second electrode 3B of the fluorescent lamp 2. A capacitor 4 is connected between the other terminal of the first electrode 3A and the second electrode 3B of the fluorescent lamp 2.

The two terminals of the secondary winding 15A of the current transformer 15 are connected to the gate and the source of the first FET 13, respectively. The two terminals of the secondary winding 15C of the current transformer 15 are connected to the gate and the source of the first FET 14, respectively. Zener diodes 21 and 22 connected in series that face each other in opposite directions are connected between the gate and the source of the first FET 13 in parallel to the secondary winding 15A of the current transformer 15. Similarly, Zener diodes 23 and 24 connected in series that face each other in opposite directions are connected between the gate and the source of the second FET 14 in parallel to a secondary winding 15C of the current transformer 15.

The secondary winding 6 of the choke coil 5 is connected in series with a series circuit composed of a capacitor 37 and a resistor 32. The gate terminal of a FET 36 is connected to the junction of the capacitor 37 and the resistor 32 via a Zener diode 35. The drain terminal and the source terminal of the FET 36 are connected to terminals of the Zener diode 22, respectively. A parallel circuit of a capacitor 33 and a resistor 34 is inserted between the junction between the resistor 32 and the secondary winding 6 of the choke coil 5 and the first FET 13. The junction between the resistors 32 and 34 is connected to a collector of a transistor 31 via a resistor 30.

Next, the operation of the ballast for a fluorescent lamp described above will be described with reference to FIG. 2. Before the start of the fluorescent lamp 2, AC supplied from the AC power source 8 is rectified by the rectifying circuit 10. The output current charges the smoothing capacitor 11 and also charges the capacitor 17 via the resistor 16. When the voltage thereof reaches the breakdown voltage of the trigger diode 18, the charges of the capacitor 17 are supplied to the gate of the second FET 14, so as to turn the second FET 14 on.

When the second FET 14 is turned on, the charges of the capacitor 17 are discharged instantly via the diode 19, and the trigger diode 18 is turned off. Further, the current from the AC power source 8 flows through a loop including the rectifying circuit 10, the capacitor 12, the first electrode 3A of the fluorescent lamp 2, the capacitor 4, the second electrode 3B of the fluorescent lamp 2, the choke coil 5, the primary winding 15B of the current transformer 15 and the second FET 14, and this current increases gradually. ext, the current flowing through the primary winding 15B of the current transformer 15 generates a voltage in the secondary winding 15C, and this voltage supplies a gate voltage to the second FET 14. Thus, the second ET 14 is maintained to be on.

When the current flowing through the windings of the current transformer 15 increases, the core of the current transformer 15 is saturated magnetically in due course. When the core of the current transformer 15 is saturated magnetically, the output from the secondary ending 15C stops so that it is no longer capable of supplying the gate voltage to the second FET 14. Thus, the second FET 14 is turned off.

At this point, the energy accumulated in the choke coil 5 allows current to flow through a loop including a parasitic diode 13A of the first FET 13, the capacitor 12, the first electrode 3A of the fluorescent lamp 2, the capacitor 4, the second electrode 3B of the fluorescent lamp 2, the choke coil 5, and the primary winding 15B of the current transformer 15, and this current decreases gradually. This current becomes primarily a resonance current of the choke coil 5 and the capacitor 4. When this current reverses, the output polarity of the secondary winding 15A reverses so that the first FET 13 turns on.

When the core of the current transformer 15 is saturated magnetically again, the output from the secondary winding 15A stops, and the first FET 13 cannot be supplied with a gate voltage. Therefore, the FET 13 turns off, and the FET 14 turns on again. Thereafter, the above-described operations are repeated so as to perform a self-oscillation inverter operation.

The zener diodes 21, 22, 23 and 24 are used basically for protecting the gates of FETs 13 and 14.

The operations based on the elements characteristic to the present invention including the timer circuit 7 have not been described above. Therefore, the operation based on elements such as the timer circuit 7, the FET 36, the secondary winding 6 of the choke coil 5 and the like will be described below.

Figure 3:
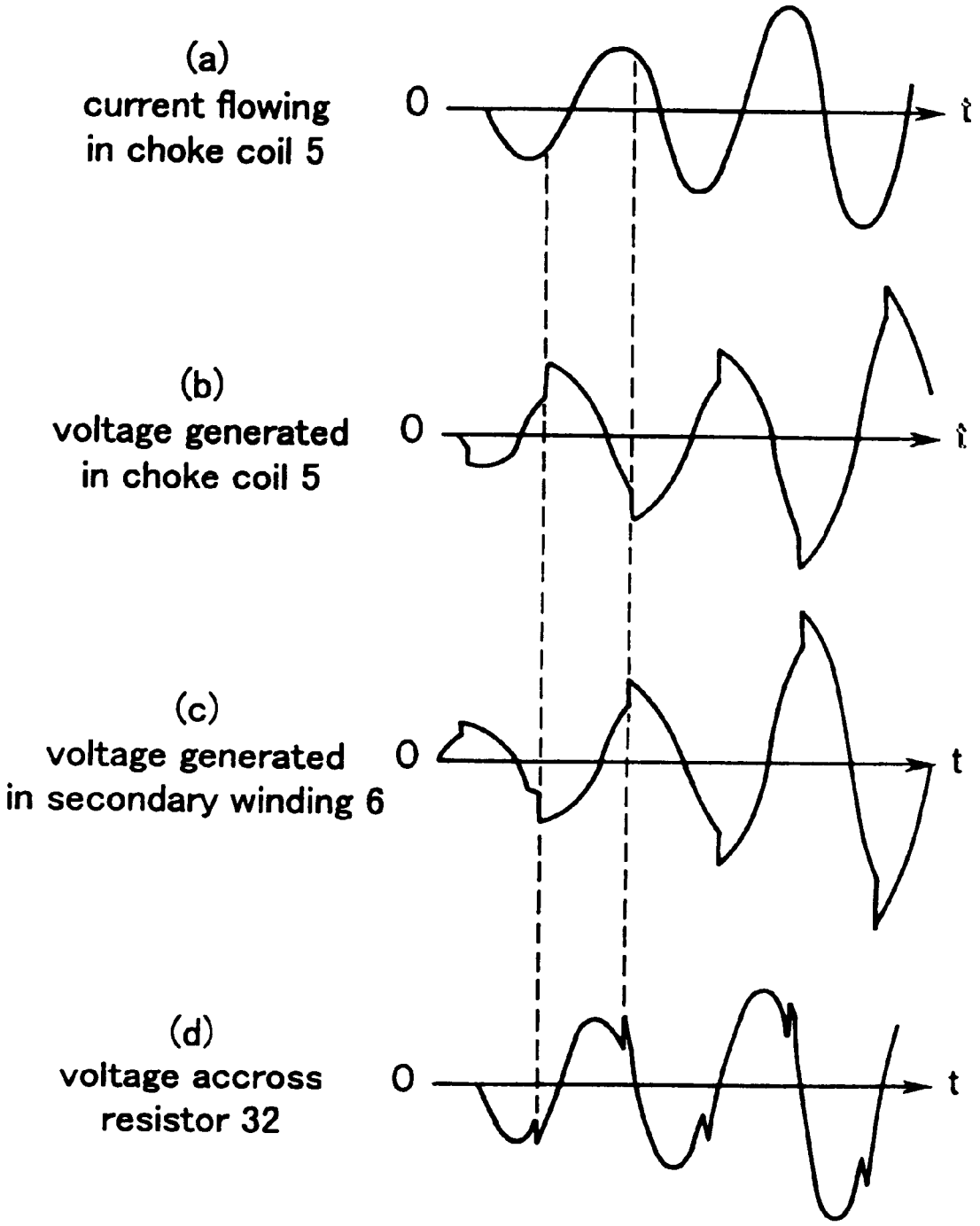
FIG. 3 is a waveform diagram showing the operation at the start of the inverter operation of the ballast for a fluorescent lamp of FIG. 1.

FIG. 3 shows four waveforms for illustrating the operation of the characteristic parts of the present invention. FIG. 3(*a*) is a waveform of a current flowing in the choke coil 5 when a self-oscillation inverter operation starts. FIG. 3(*b*) is a waveform of a voltage generated across the choke coil 5. FIG. 3(*c*) is a waveform of a voltage generated at the secondary winding 6 of the choke coil 5. FIG. 3(*d*) is a waveform of a voltage applied to the resistor 32.

The waveform (b) of a voltage generated across the choke coil 5 has a phase 90° ahead with respect to the waveform (a) of the current, and the amplitude thereof increases as time lapses. A saw-tooth-shaped waveform portion added to the voltage waveform (b) of the choke coil 5 is a kick voltage generated at the choke coil 5 when the first FET 13 or the second FET 14 turns off and the current paths are switched. The voltage waveform (c) generated at the secondary winding 6 of the choke coil 5 is shifted in phase by 180° with respect to the voltage (b) generated at the choke coil 5, because the secondary winding 6 is wound so that the polarity is reversed.

The voltage waveform (c) generated at the secondary winding 6 causes current to flow through a loop including the capacitor 37 and the resistor 32. Since the impedance of the capacitor 37 is set higher than that of the resistor 32, the current has a phase about 90° ahead with respect to the voltage (c) generated at the secondary winding 6, and a voltage applied to the resistor 32 also has a phase about 900 ahead. Therefore, the waveform (d) of the voltage applied to resistor 32 is substantially in phase with the waveform (a) of the current flowing in the choke coil 5, and becomes a voltage signal corresponding to the current. In this case, a saw-tooth-shaped voltage waveform portion added to this waveform is generated when the first FET 13 or the second FET 14 turns off, so that the phase thereof is equal to the phase of the voltage generated at the secondary winding 6 of the choke coil 5, and they are never out of phase.

Figure 4:
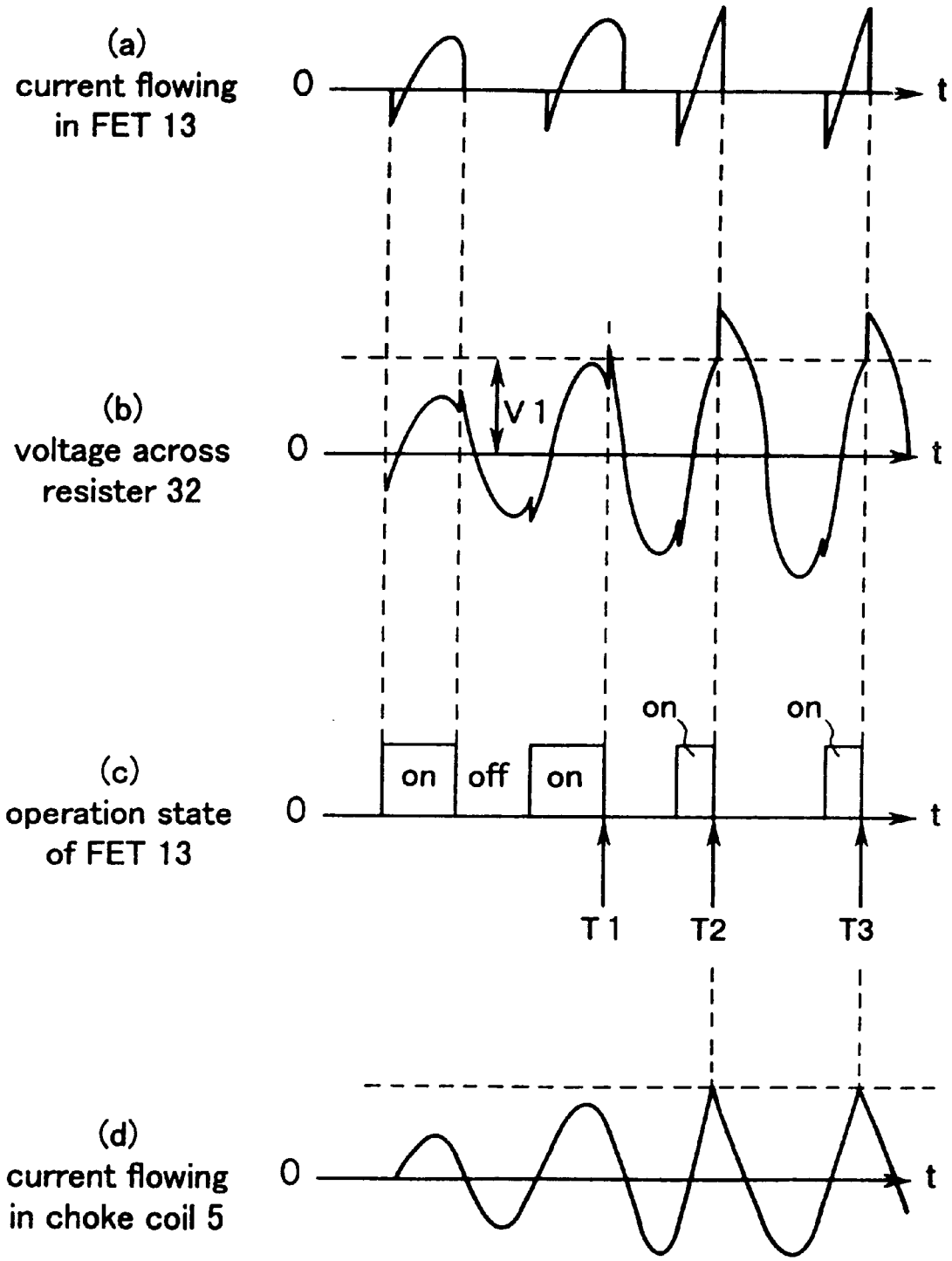
FIG. 4 is a waveform diagram showing the operation in a preheat state of the ballast for a fluorescent lamp of FIG. 1.

FIG. 4(*a*) is a waveform of a current flowing in the first FET 13. FIG. 4(*b*) is a waveform of a voltage applied to the resistor 32. FIG. 4(*c*) is an operation state of the first FET 13. FIG. 4(*d*) is a waveform of a current flowing in the choke coil 5. The initial voltage of the capacitor 33 is 0, and only the voltage (b) applied to the resistor 32 is applied to the Zener diode 35. At time T1 when this voltage exceeds a Zener voltage V1 of the Zener diode 35, the FET 36 (switch control element) turns on. When the FET 36 turns on, the charges of the gate of the first FET 13 are discharged via the Zener diode 21 and the drain and the source of the FET 36. However, as shown in FIG. 4(*c*), this point is present after time T1 and therefore the first FET 13 already has turned off, so that the operation of the first FET 13 is not affected.

Next, when the FET 36 turns on at time T2, the charges of the gate of the first FET 13 are discharged via the Zener diode 21 and the drain and the source of the FET 36, and thus the first FET 13 changes state from being on to off. At this point, the current (a) flowing in the first FET 13 is interrupted, and this current is switched so as to flow in the parasitic diode 14A of the second FET 14 so that the continuity is maintained.

At the time of the switching of the current, a kick voltage is generated at the choke coil 5 and the secondary winding 6, and an in-phase saw-tooth-shaped voltage is generated across the resistor 32, as shown in waveform (b). This saw-tooth-shaped voltage supplies the gate voltage of the FET 36 so that the FET 36 is maintained on, and therefore the first FET 13 is maintained off. This means that the FET 36 has a latch function of staying on after it turns on. Therefore, a complicated circuit configuration for the latch function is not necessary, and a simple circuit configuration can be achieved.

The ON-state of the FET 36 is reset by a voltage with reversed polarity applied to the resistor 32 before a next cycle. As shown in FIG. 4(*c*), an ON-period of the first FET 13 is shortened after time T1 when the voltage (b) applied to the resistor 32 exceeds the Zener voltage V1 of the Zener diode 35. Thus, since the ON-period of the first FET 13 is shortened, namely, the operation is being performed with duty control, the amplitude of the current (d) flowing in the choke coil 5 can be restricted to a constant value. This controlled current flows through the first electrode 3A of the fluorescent lamp 2, the capacitor 4, and the second electrode 3B of the fluorescent lamp 2, so that the resonant voltage generated in the capacitor 4 is restricted to a constant value and does not reach a voltage that breaks down the fluorescent lamp 2. This current preheats the first electrodes 3A and the second electrodes 3B of the fluorescent lamp 2. The current value for preheating is set to be a value that allows the first electrodes 3A and the second electrodes 3B to be preheated for a short time. In this manner as described above, a circuit for duty-controlling the first FET 13 by the secondary winding 6, the capacitor 37, the resistor 32 and the Zener diode 35, using the FET 36 as a switch control element, is provided.

Figure 5:
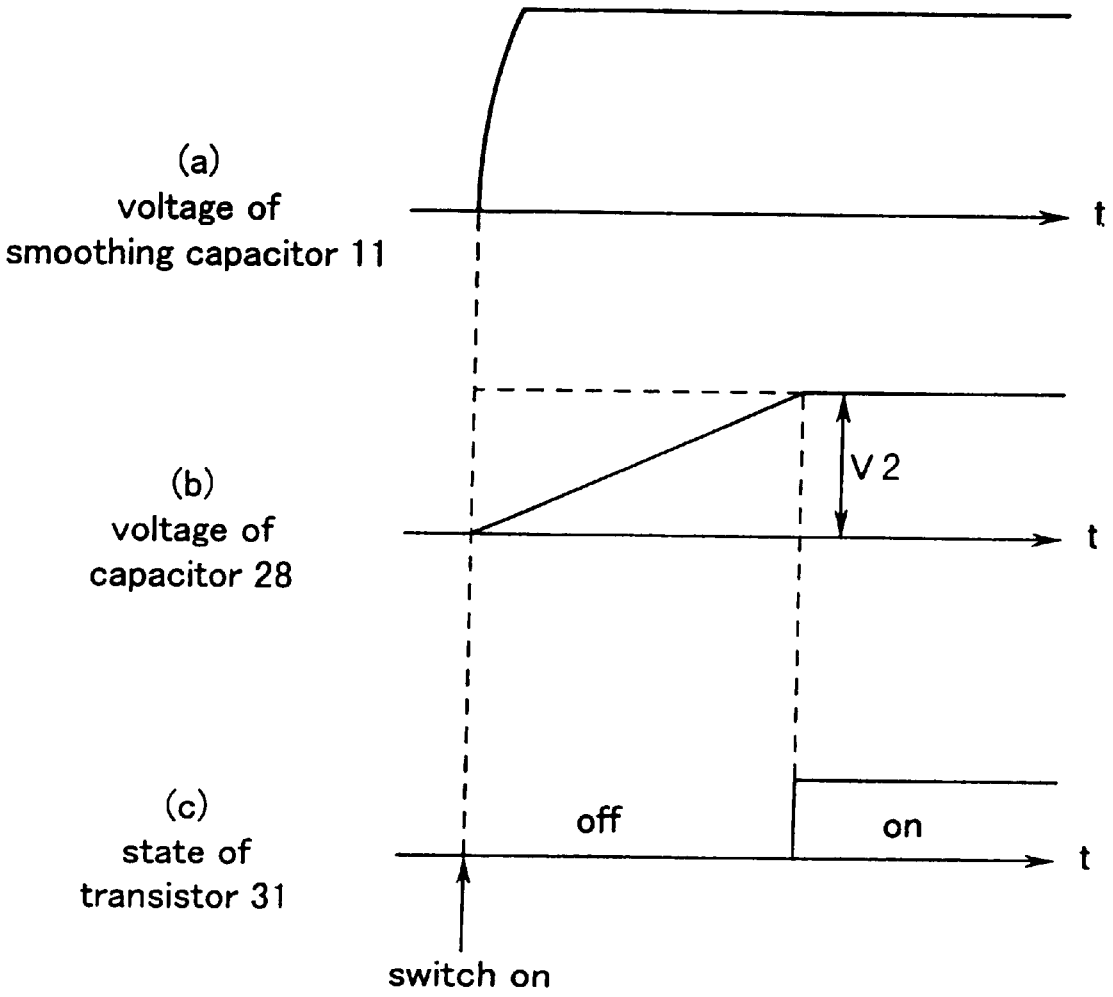
FIG. 5 is a waveform diagram showing the operation of a timer circuit of the ballast for a fluorescent lamp of FIG. 1.

FIG. 5 is a diagram showing the operation of the timer circuit 7. FIG. 5(*a*) is a waveform of a voltage of the smoothing capacitor 11 after the switch 9 is on. FIG. 5(*b*) is a waveform of a voltage of the capacitor 28 of the timer circuit 7. FIG. 5(*c*) shows an ON state and an OFF state of the transistor 31.

Since charging current flows from the smoothing capacitor 11 to the capacitor 28 via the resistor 26, the voltage (b) of the capacitor 28 increases gradually. When the voltage (b) of the capacitor 28 reaches a Zener voltage V2 of the Zener diode 29, current flows from the capacitor 28 to the base of the transistor 31 via the Zener diode 29, and the transistor 31 changes from being off to on. Thus, the transistor 31 is off for a predetermined period after the switch turns on, and thereafter stays on.

When the transistor 31 turns on, current flows through the capacitor 11, the first FET 13, the capacitor 33, the resistor 30 and the transistor 31 during a period in which the first FET 13 is on, so that the capacitor 33 is charged.

Figure 6:
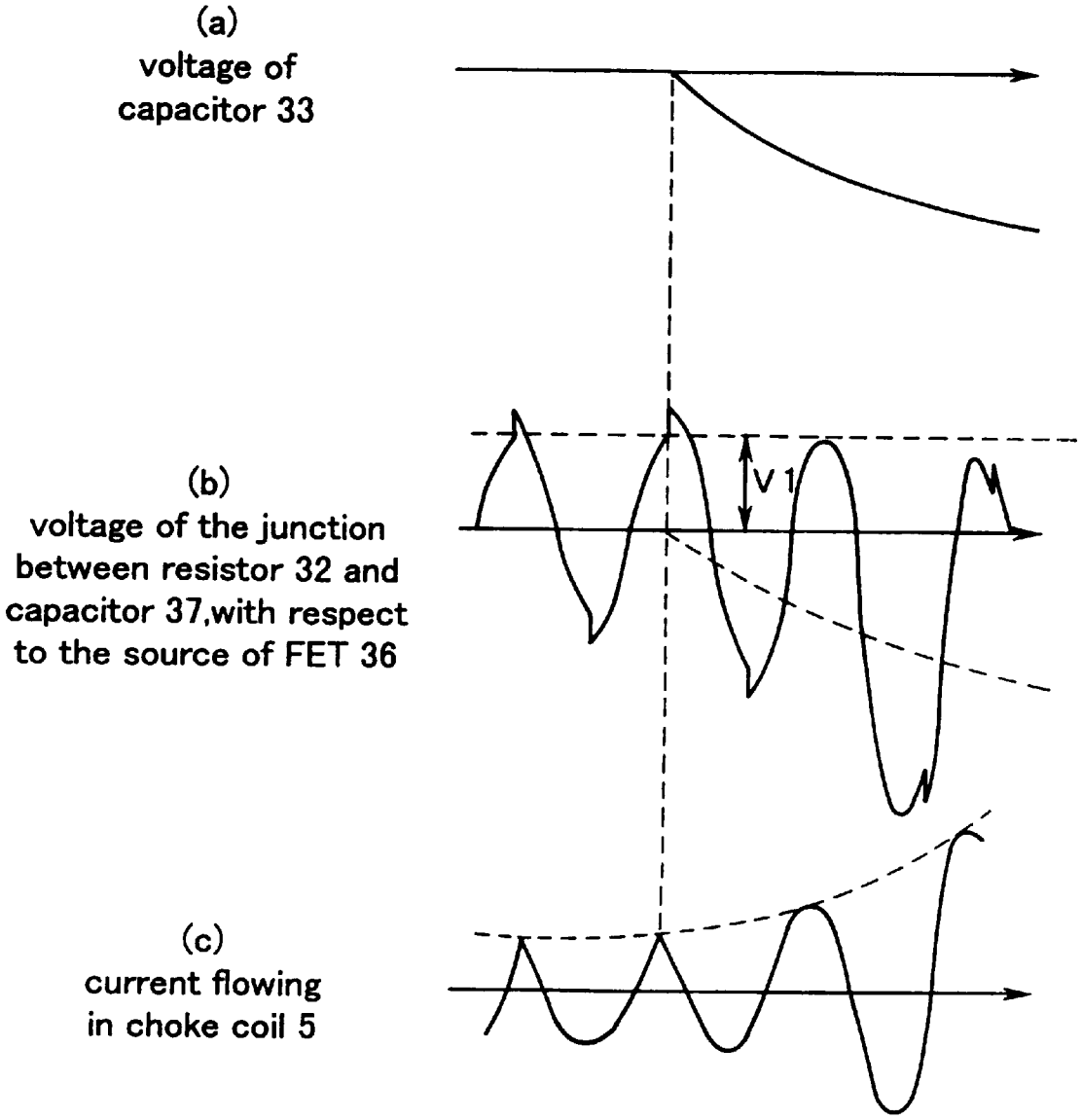
FIG. 6 is a waveform diagram showing the operation of the ballast for a fluorescent lamp of FIG. 1 when the fluorescent lamp is activated.

The waveform of FIG. 6(*a*) shows a voltage of the upper terminal of the capacitor 33 with respect to the source of the FET 36. When the transistor 31 turns on, the capacitor 33 is charged with a negative voltage at the same time. The waveform of FIG. 6(*b*) shows a voltage at the junction between the resistor 32 and the capacitor 37 with respect to the source of the FET 36, which is an addition voltage of the capacitor 33 and the resistor 32.

When the capacitor 33 is charged, the addition voltage of the capacitor 33 and the resistor 32 shifts to the negative voltage, and the Zener voltage V1 of the Zener diode 35, which is a threshold value that turns the FET 35 on, is raised relatively. Therefore, the amplitude of the current (c) flowing in the choke coil 5 increases without being restricted to a constant value. The resonant voltage that is generated in the capacitor 4 also increases and reaches a voltage that breaks down the fluorescent lamp 2. Thus, the fluorescent lamp starts.

The first electrode 3A and the second electrode 3B of the fluorescent lamp 2 starts to discharge in the state where they are preheated so that thermoelectrons are supplied sufficiently. Therefore, the loss of active substances applied to the first electrode 3A and the second electrode 3B due to positive ion bombardment can be reduced, so that the lives of the first electrode 3A and the second electrode 3B can be prolonged.

Figure 7:
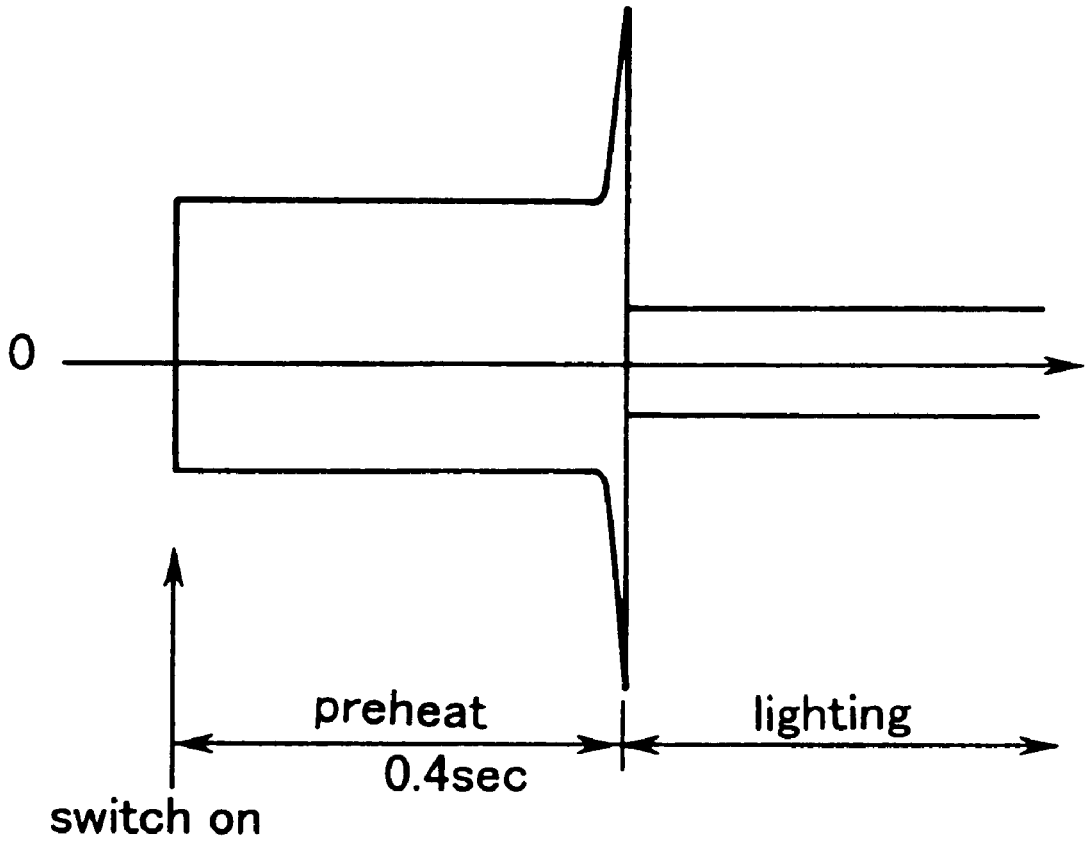
FIG. 7 is a waveform diagram showing preheating current of the ballast for a fluorescent lamp of FIG. 1.
Figure 8:
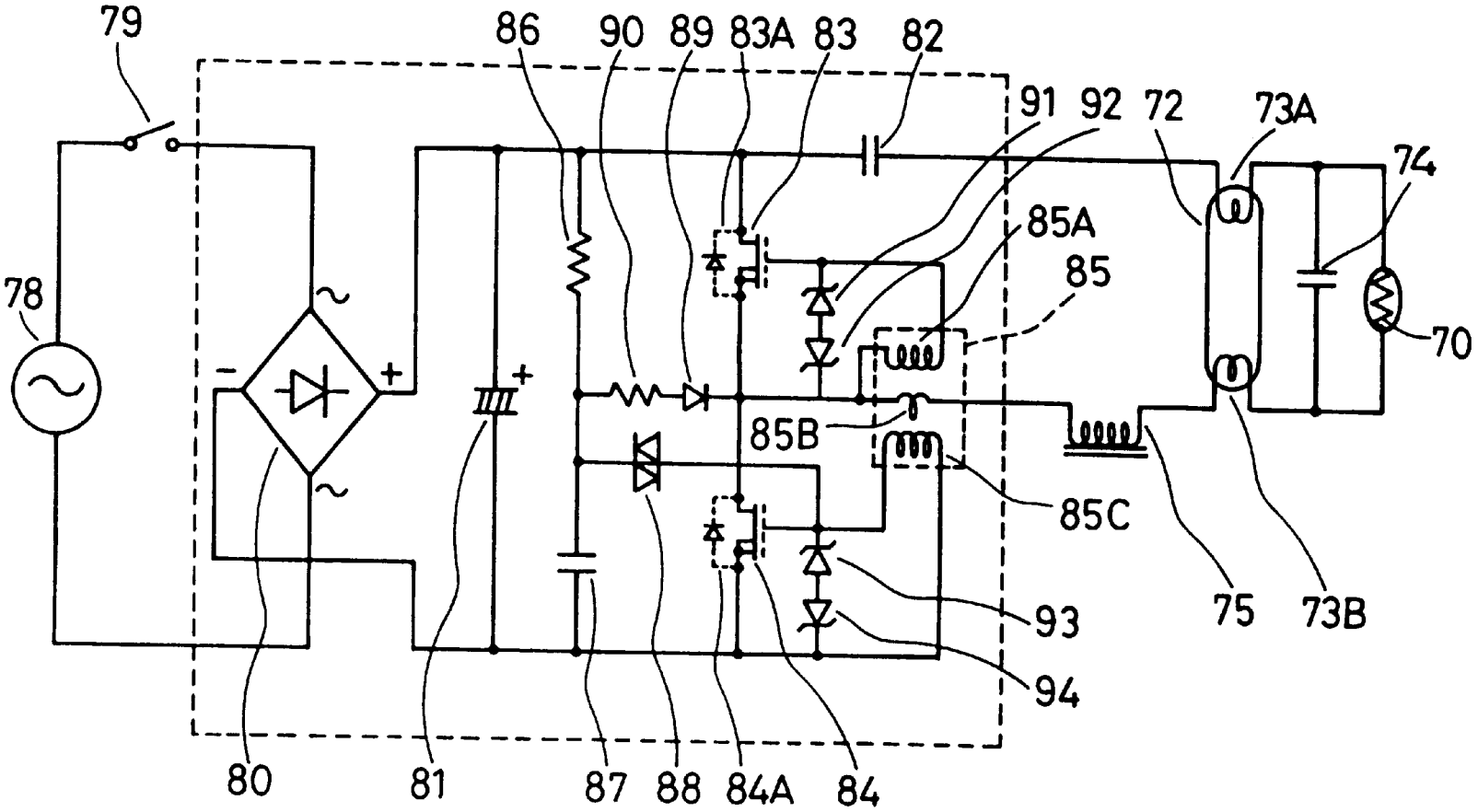
FIG. 8 PRIOR ART
FIG. 8 is a circuit diagram of a conventional ballast for a fluorescent lamp.

FIG. 7 shows an envelope curve waveform of preheat current flowing through the first electrode 3A and the second electrode 3B of the fluorescent lamp 2 from preheating until lighting. This diagram shows the manner that upon switching on, a high frequency current flows and the fluorescent lamp lights up in a predetermined period. The preheat period until lighting is about 0.4 seconds, which is a short time.

After the light is put out by turning off the switch 9, the charges of the capacitor 28 are discharged via the resistor 27. Further, the charges of the capacitor 33 are discharged via the resistor 34. Since the time constant in both circuits is set at 1 second or less, the timer circuit 7 is reset within 5 seconds after the light is put out. Therefore, even if the switch is turned on in a short time after the light is put out, the fluorescent lamp 2 starts after suitable preheating for about 0.4 seconds so that the loss of active substances applied to the electrodes 3 due to positive ion bombardment can be reduced and the lives of the electrodes 3 can be prolonged.

This embodiment includes two switching elements, the first FET 13 and the second FET 14. However, the present invention is not limited thereto. The present invention can be applied to a configuration including three or more switching elements that repeat alternate on-and-off operations.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A ballast for a fluorescent lamp including a high frequency power source circuit for supplying a preheat start type fluorescent lamp with preheating and lighting current via an inductor, said high frequency power source circuit comprising:

at least two switching elements for respectively controlling application of voltages of different polarity to the fluorescent lamp;

a self-exciting type switching element driving circuit for driving said switching elements so as to alternate between on and off repeatedly; and a timer circuit for detecting lapse of a predetermined time from a start of the ballast for the fluorescent lamp;

wherein said switching element driving circuit shortens an ON-period of at least one of said switching elements to restrict an increase of an amplitude of current flowing in the inductor during a period until the timer circuit detects the lapse of the predetermined time.

2. A ballast for a fluorescent lamp according to claim 1, wherein said timer circuit comprises a capacitor being charged so as to reach a predetermined voltage after said predetermined time passes from start of the ballast, whereby the lapse of said predetermined time is detected based on a voltage of said capacitor; and a resistor for discharging charges of said capacitor after the fluorescent lamp is put out.

3. A ballast for a fluorescent lamp according to claim 1, wherein said switching element driving circuit comprises a switch control element for turning off a predetermined one of said switching elements in response to current flowing in said inductor to shorten the ON period, and said switch control element is controlled to operate only during a period until said timer circuit detects the lapse of the predetermined time.

4. A ballast for a fluorescent lamp according to claim 3, wherein said inductor is provided with a secondary winding, an output voltage signal of the secondary winding being supplied to said switch control element, and said switch control element operates in response to the output voltage signal of the secondary winding so as to turn off the predetermined switching element when the output voltage signal of the secondary winding exceeds a predetermined voltage.

5. A ballast for a fluorescent lamp according to claim 4, wherein said switch control element maintains an operation state where it turns off the predetermined switching element, by a kick voltage generated in the secondary winding of said inductor when the switching element is switched between on and off.

* * * * *